US009060567B2

(12) United States Patent
Elder et al.

(10) Patent No.: US 9,060,567 B2
(45) Date of Patent: Jun. 23, 2015

(54) ARTICLE OF FOOTWEAR WITH TENSILE STRUCTURE

(71) Applicant: Nike, Inc., Beaverton, OR (US)

(72) Inventors: Zachary M. Elder, Portland, OR (US); Dervin A. James, Hillsboro, OR (US); Elizabeth A. Kilgore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 279 days.

(21) Appl. No.: 13/849,348

(22) Filed: Mar. 22, 2013

(65) Prior Publication Data

US 2014/0283412 A1 Sep. 25, 2014

(51) Int. Cl.

| | |
|---|---|
| ***A43B 23/22*** | (2006.01) |
| ***A43B 13/18*** | (2006.01) |
| ***A43B 7/14*** | (2006.01) |
| ***A43B 7/28*** | (2006.01) |
| ***A43B 13/20*** | (2006.01) |

(52) U.S. Cl.

CPC ..... *A43B 13/18* (2013.01); *A43B 7/1465* (2013.01); *A43B 7/1495* (2013.01); *A43B 7/28* (2013.01); *A43B 13/189* (2013.01); *A43B 13/20* (2013.01)

(58) Field of Classification Search

CPC ..... A43B 7/14; A43B 13/20; A43B 13/18; A43B 23/22; A43B 23/227

USPC ..... 36/50.1, 88, 89, 91, 92, 102, 29

See application file for complete search history.

(56) References Cited

U.S. PATENT DOCUMENTS

| | | | | |
|---|---|---|---|---|
| 2,495,984 | A | | 1/1950 | Roy |
| 4,592,154 | A | | 6/1986 | Oatman |
| 4,654,985 | A | | 4/1987 | Chalmers |
| 4,811,503 | A | | 3/1989 | Iwama |
| 5,291,671 | A | * | 3/1994 | Caberlotto et al. ..... 36/88 |
| 5,295,314 | A | * | 3/1994 | Moumdjian ..... 36/29 |
| 5,371,957 | A | | 12/1994 | Gaudio |
| 5,408,761 | A | * | 4/1995 | Gazzano ..... 36/88 |

(Continued)

FOREIGN PATENT DOCUMENTS

| | | |
|---|---|---|
| CN | 202335387 | 7/2012 |
| FR | 2697727 | 10/1993 |

(Continued)

OTHER PUBLICATIONS

International Search Report and Written Opinion in connection with International Application No. PCT/US2014/019542, mailed Jun. 26, 2014.

(Continued)

*Primary Examiner* — Marie Bays

(74) *Attorney, Agent, or Firm* — Honigman Miller Schwartz and Cohn LLP; Matthew H. Szalach; Jonathan P. O'Brien

(57) ABSTRACT

An article of footwear includes an upper having a first area and a second area. The footwear also includes a sole structure that is coupled to the upper. The sole structure includes a bladder that contains a fluid. Moreover, the footwear includes a tensile structure that is coupled to the first area of the upper, that extends through the sole structure, and that is coupled to the second area of the upper. The tensile structure is operably coupled to the bladder. The tensile structure is operable to flex the bladder due to an increase in tension in the tensile structure.

23 Claims, 6 Drawing Sheets

(56) References Cited

U.S. PATENT DOCUMENTS

| | | | | |
|---|---|---|---|---|
| 5,678,329 | A | 10/1997 | Griffin et al. | |
| 5,692,319 | A * | 12/1997 | Parker et al. | 36/50.1 |
| 5,755,044 | A | 5/1998 | Veylupek | |
| 5,819,439 | A * | 10/1998 | Sanchez | 36/89 |
| 6,032,387 | A | 3/2000 | Johnson | |
| 6,052,921 | A | 4/2000 | Oreck | |
| 6,286,233 | B1 | 9/2001 | Gaither | |
| 6,378,230 | B1 | 4/2002 | Rotem et al. | |
| 6,598,322 | B2 | 7/2003 | Jacques et al. | |
| 6,772,541 | B1 | 8/2004 | Ritter | |
| 7,134,224 | B2 | 11/2006 | Elkington et al. | |
| D553,842 | S | 10/2007 | Paz | |
| 7,343,701 | B2 | 3/2008 | Pare et al. | |
| 7,546,698 | B2 * | 6/2009 | Meschter | 36/45 |
| 7,562,470 | B2 | 7/2009 | Keen | |
| 7,568,298 | B2 | 8/2009 | Kerns | |
| 7,793,435 | B1 | 9/2010 | Ruth | |
| 8,006,410 | B2 | 8/2011 | Romboli et al. | |
| 8,074,379 | B2 | 12/2011 | Robinson et al. | |
| 8,122,616 | B2 * | 2/2012 | Meschter et al. | 36/45 |
| 8,151,490 | B2 | 4/2012 | Sokolowski | |
| 8,230,618 | B2 | 7/2012 | Bruce et al. | |
| 8,667,711 | B2 * | 3/2014 | Carboy et al. | 36/45 |
| 8,677,652 | B2 * | 3/2014 | Marvin et al. | 36/45 |
| 2004/0003515 | A1 | 1/2004 | Marvin et al. | |
| 2004/0181972 | A1 * | 9/2004 | Csorba | 36/50.1 |
| 2005/0132607 | A1 | 6/2005 | Dojan et al. | |
| 2005/0217145 | A1 * | 10/2005 | Miyauchi et al. | 36/30 R |
| 2005/0284000 | A1 | 12/2005 | Kerns | |
| 2006/0048413 | A1 | 3/2006 | Sokolowski et al. | |
| 2007/0011910 | A1 * | 1/2007 | Keen | 36/50.1 |
| 2007/0011914 | A1 * | 1/2007 | Keen et al. | 36/50.1 |
| 2007/0271822 | A1 | 11/2007 | Meschter | |
| 2008/0110049 | A1 | 5/2008 | Sokolowski et al. | |
| 2009/0126231 | A1 | 5/2009 | Malmivaara | |
| 2009/0178300 | A1 | 7/2009 | Parker | |
| 2010/0018075 | A1 * | 1/2010 | Meschter et al. | 36/45 |
| 2010/0077634 | A1 | 4/2010 | Bell | |
| 2010/0154256 | A1 | 6/2010 | Dua et al. | |
| 2011/0197475 | A1 | 8/2011 | Weidl et al. | |
| 2011/0258876 | A1 | 10/2011 | Baker et al. | |
| 2012/0023686 | A1 | 2/2012 | Huffa et al. | |
| 2012/0131818 | A1 | 5/2012 | Nishiwaki et al. | |
| 2012/0233882 | A1 | 9/2012 | Huffa et al. | |
| 2012/0240428 | A1 | 9/2012 | Knoll | |
| 2012/0255201 | A1 | 10/2012 | Little | |
| 2012/0260526 | A1 | 10/2012 | Smith et al. | |

FOREIGN PATENT DOCUMENTS

| | | |
|---|---|---|
| JP | 09065908 | 3/1997 |
| JP | 2007190351 | 8/2007 |
| WO | 2014153433 A2 | 9/2014 |

OTHER PUBLICATIONS

International Search Report and Written Opinion in connection with International Application No. PCT/US2014/019548, mailed Jun. 26, 2014.

International Search Report and Written Opinion for Application No. PCT/US2014/031276, mailed Sep. 26, 2014, 13 pages.

* cited by examiner

ARTICLE OF FOOTWEAR WITH TENSILE STRUCTURE

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that generally extends over instep and toe areas of the foot, along medial and lateral sides of the foot, and around a heel area of the foot. The upper may also incorporate a closure element (e.g., a shoelace, buckle, strap, etc.) to selectively adjust the fit of the footwear, as well as permitting entry and removal of the foot from the void within the upper. In addition, the upper may include a tongue that extends under the closure element to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. In some configurations, the midsole may be primarily formed from a fluid-filled chamber. The outsole forms a ground-contacting element of the footwear and is usually fashioned from a durable and wear-resistant rubber material that may include texturing to impart traction. The sole structure may also include a sockliner positioned within the void of the upper to contact and support a lower surface of the foot to enhance footwear comfort.

SUMMARY

An article of footwear configured for wearing on a foot of a wearer is disclosed. The article of footwear includes an upper having a first area and a second area. The footwear also includes a sole structure that is coupled to the upper. The sole structure includes a bladder that contains a fluid. The footwear further includes a tensile structure that is coupled to the first area of the upper, that extends through the sole structure, and that is coupled to the second area of the upper. The tensile structure is operably coupled to the bladder. The tensile structure is operable to flex the bladder due to an increase in tension in the tensile structure.

Moreover, an article of footwear configured for wearing on a foot of a wearer is disclosed. The article of footwear includes an upper having a first closure area and a second closure area that are separated by a gap. The first closure area and the second closure area are operable to support a closure element that has an unfastened position and a fastened position. The closure element is operable to reduce a size of the gap to selectively secure the upper to the foot of the wearer when moving from the unfastened position to the fastened position. The footwear also includes a sole structure that is coupled to the upper, and the sole structure includes a bladder that contains a fluid. Additionally, the footwear includes a closure tensile structure that is coupled to the first closure area of the upper, that extends through the sole structure, and that is coupled to the second closure area of the upper. The closure tensile structure is operably coupled to the bladder. The closure tensile structure is operable to flex the bladder when the closure element moves from the unfastened position to the fastened position.

Additionally, an article of footwear configured for wearing on a foot of a wearer is disclosed. The article of footwear includes an upper having a medial side with a first eyelet and a lateral side with a second eyelet. A gap is defined between the medial side and the lateral side. The footwear also includes a shoelace received in the first eyelet and the second eyelet and operable to selectively move at least one of the first eyelet and the second eyelet toward the other to selectively secure the upper to the foot of the wearer. Additionally, the footwear includes a heel strap that extends across a heel region of the upper. The heel strap includes a first end disposed on the medial side and a second end disposed on the lateral side. Furthermore, the footwear includes a sole structure that is coupled to the upper. The sole structure includes a bladder that contains a fluid. The bladder includes a first chamber portion, a second chamber portion, and a flexible joint portion that couples the first chamber portion and the second chamber portion. Moreover, the footwear includes a plurality of closure strands that are coupled to the upper adjacent the first eyelet, that fan apart from the first eyelet, that extend through sole structure, that converge toward the second eyelet, and that are coupled to the upper adjacent the second eyelet. The plurality of closure strands are operably coupled to the bladder and are collectively operable to flex at least one of the first chamber portion and the second chamber portion relative to the other as a result of the shoelace securing the upper to the foot of the wearer. Additionally, the footwear includes a plurality of heel strands that are coupled to the first end of the heel strap, that fan apart from the first end of the heel strap, that extend through the sole structure, that converge toward the second end of the heel strap, and that are coupled to the second end of the heel strap. The plurality of heel strands are operably coupled to the bladder and are collectively operable to flex at least one of the first chamber portion and the second chamber portion relative to the other as a result of flexure of the upper.

The advantages and features of novelty characterizing aspects of the present disclosure are pointed out with particularity in the appended claims. To gain an improved understanding of the advantages and features of novelty, however, reference may be made to the following descriptive matter and accompanying figures that describe and illustrate various configurations and concepts related to the present disclosure.

FIGURE DESCRIPTIONS

The foregoing Summary and the following Detailed Description will be better understood when read in conjunction with the accompanying figures.

DETAILED DESCRIPTION

The following discussion and accompanying figures disclose various articles of footwear having a tensile structure that operably couple areas of the upper to the sole structure. For instance, the tensile structure may comprise one or more strands that can extend continuously from a first area of the upper, underneath the foot through the sole structure, to a second area of the upper. Also, in some embodiments, the sole structure can include a bladder that contains a fluid, and the strand(s) can be coupled to the bladder. Moreover, the strand(s) can operably couple a closure element, such as a shoelace, etc., to the sole structure and the bladder such that moving the closure element from an unfastened position to a fastened position flexes the bladder. Furthermore, the strand(s) can extend between and operably couple a heel or ankle region of the upper to the sole structure and the bladder. As such, the strand(s) can pull the heel/ankle region of the upper into the wearer's heel due to tension in the strand(s). Moreover, the tensile structure can cause the upper, the sole structure, and/or the bladder to flex, shift, and conform to the wearer's foot as the foot moves during running, jumping, pivoting, and other movements. Accordingly, the tensile structure can increase comfort and improve support of the wearer's foot.

The articles of footwear are disclosed, for purposes of example, as having configurations of running shoes. Concepts associated with the articles of footwear, including the uppers, may also be applied to a variety of other athletic footwear types, including basketball shoes, baseball shoes, cross-training shoes, cycling shoes, football shoes, tennis shoes, golf shoes, soccer shoes, walking shoes, hiking boots, ski and snowboard boots, and ice and roller skates, for example. The concepts may also be applied to footwear types that are generally considered to be non-athletic, including dress shoes, loafers, sandals, and work boots. The concepts disclosed herein apply, therefore, to a wide variety of footwear types.

Figure 1:
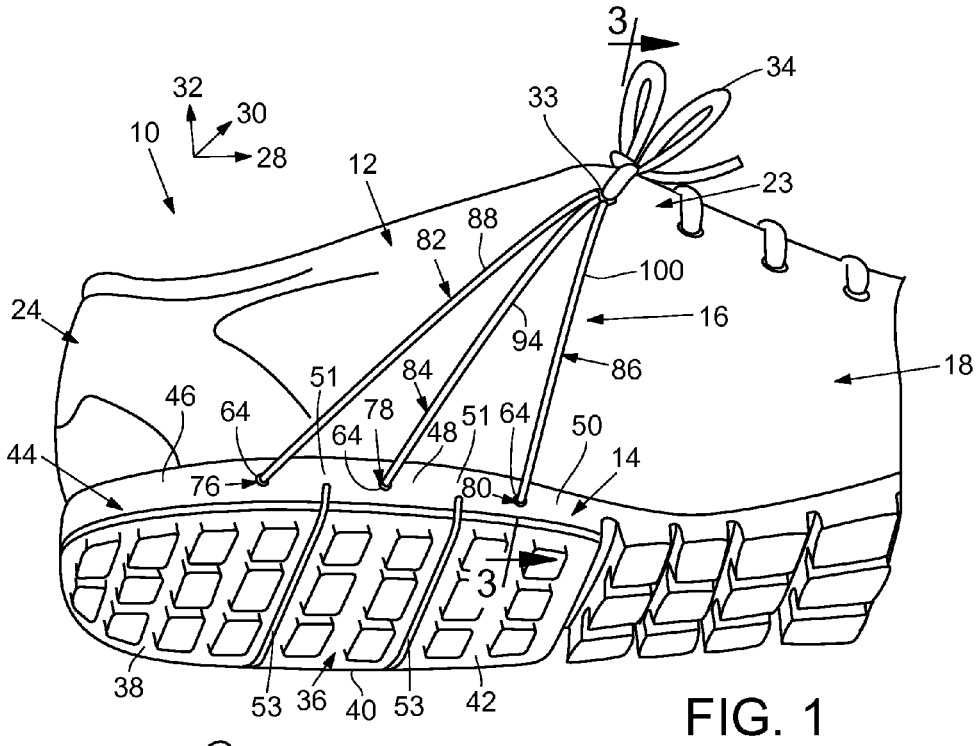
FIG. 1 is a perspective view of an article of footwear with tensile strands according to exemplary embodiments of the present disclosure.
Figure 2:
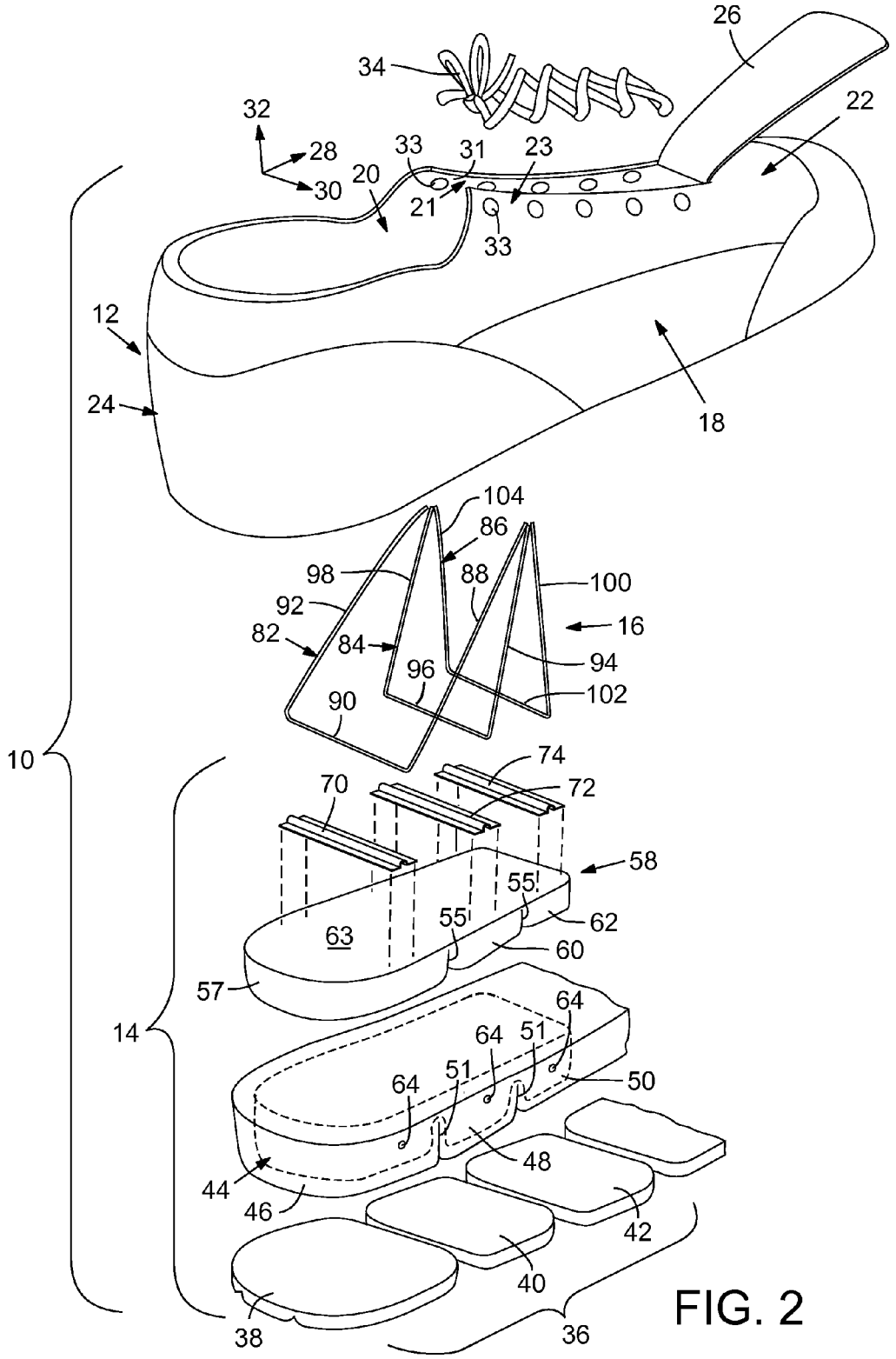
FIG. 2 is an exploded view of the article of footwear of FIG. 1.
Figure 3:
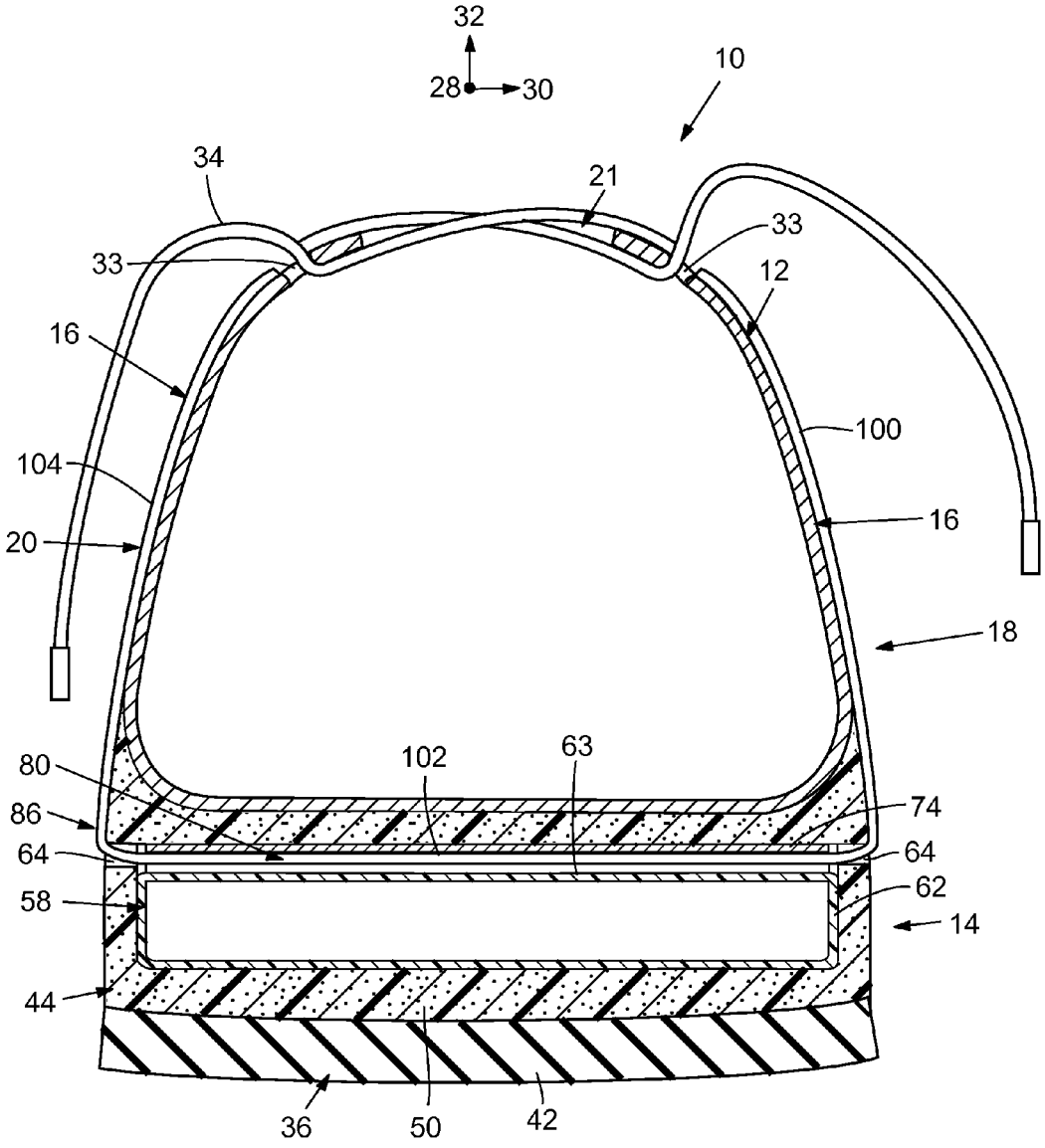
FIG. 3 is a section view of the article of footwear of FIG. 1 taken along the line 3-3.

Referring now to FIGS. 1-3, an article of footwear 10 is depicted according to exemplary embodiments of the present disclosure. The footwear 10 generally includes an upper 12, a sole structure 14, and tensile structure 16. In some embodiments, the tensile structure 16 can include at least one or more strands 82, 84, 86, such as wires, cables, or other elongate, flexible strands as will be discussed in detail below. However, it will be appreciated that the tensile structure 16 can include straps, ribbons, or other structures without departing from the scope of the present disclosure.

The sole structure 14 is secured to a lower area of upper 12 and extends between upper 12 and the ground surface, such as a sidewalk, grass, or the like. Upper 12 provides a comfortable and secure covering for a foot of a wearer. The sole structure 14 extends under the foot to attenuate forces, enhance stability, or influence the motions of the foot, for example. The tensile structure 16 can operably couple different areas of the upper 12 and the sole structure 14 together such that the footwear 10 fits securely and comfortably to the wearer's foot, such that the footwear 10 flexes with the foot, and such that the footwear 10 provides support during running, jumping, pivoting, and other movements.

For purposes of reference in the following discussion, footwear 10 may be divided into various regions: a medial side 18, a lateral side 20, a forefoot region 22, and a heel region 24. As referenced herein, these regions 22, 24 and sides 18, 20 are not intended to demarcate precise areas of footwear 10. Rather, regions 22, 24 and sides 18, 20 are intended to represent general areas of footwear 10 and to aid in the following discussion. In addition to footwear 10, regions 22, 24 and sides 18, 20 may also be applied to sole structure 14, upper 12, and individual elements thereof. Moreover, the footwear 10 can define a longitudinal direction 28, a transverse direction 30, and a superior-inferior direction 32.

Forefoot region 22 generally includes portions of footwear 10 corresponding with the toes and the joints connecting the metatarsals with the phalanges. Heel region 24 generally corresponds with rear portions of the foot, including the calcaneus bone and areas surrounding the Achilles tendon in the posterior of the heel or ankle of the foot. The medial and lateral sides 18, 20 can extend between the forefoot and heel regions 22, 24 and can correspond with opposite sides of footwear 10. More particularly, lateral side 20 corresponds with an outer area of the foot, the surface that faces away from the other foot, and medial side 18 corresponds with an inner area of the foot, the surface that faces toward the other foot.

The upper 12 will now be discussed in more detail. The upper 12 may be formed from a variety of sheet-like elements that are stitched, adhesively bonded, or otherwise joined together to define a cavity that receives the wearer's foot. As such, upper 12 can extend along the lateral side of the foot, along the medial side of the foot, over the superior regions of the foot, around a heel of the foot, and under the inferior regions of the foot.

The upper 12 can define a medial closure area 23 and a lateral closure area 31, and a gap 21 can be defined between the areas 23, 31. The closure areas 23, 31 can be operable to provide support for a closure element, such as a shoelace 34. The shoelace 34 can be flexible, but can have a substantially fixed length such that the shoelace 34 is substantially non-extendable in length, or the shoelace 34 can be resiliently elastic such that the shoelace 34 is resiliently extendable.

The closure areas 23, 31 can each include a plurality of openings, or eyelets 33, that are substantially aligned in the longitudinal direction 28. The shoelace 34 can be received in the eyelets 33 and can zigzag and alternate between the medial closure area 23 and the lateral closure area 31.

It will be appreciated that the footwear 10 could include a closure element other than shoelace 34. For instance, the footwear 10 can include a strap with pile tape VELCRO™, a strap that buckles to a corresponding portion of the upper 12, an elastic sheet or strap, a snap, a button, or other closure element. Also, the footwear 10 can include a rigid ring, a post, or another implement other than eyelets 33 for attaching the shoelace 34 to the upper 12. The term eyelet 33 is used generally to refer to all such implements.

Figure 4:
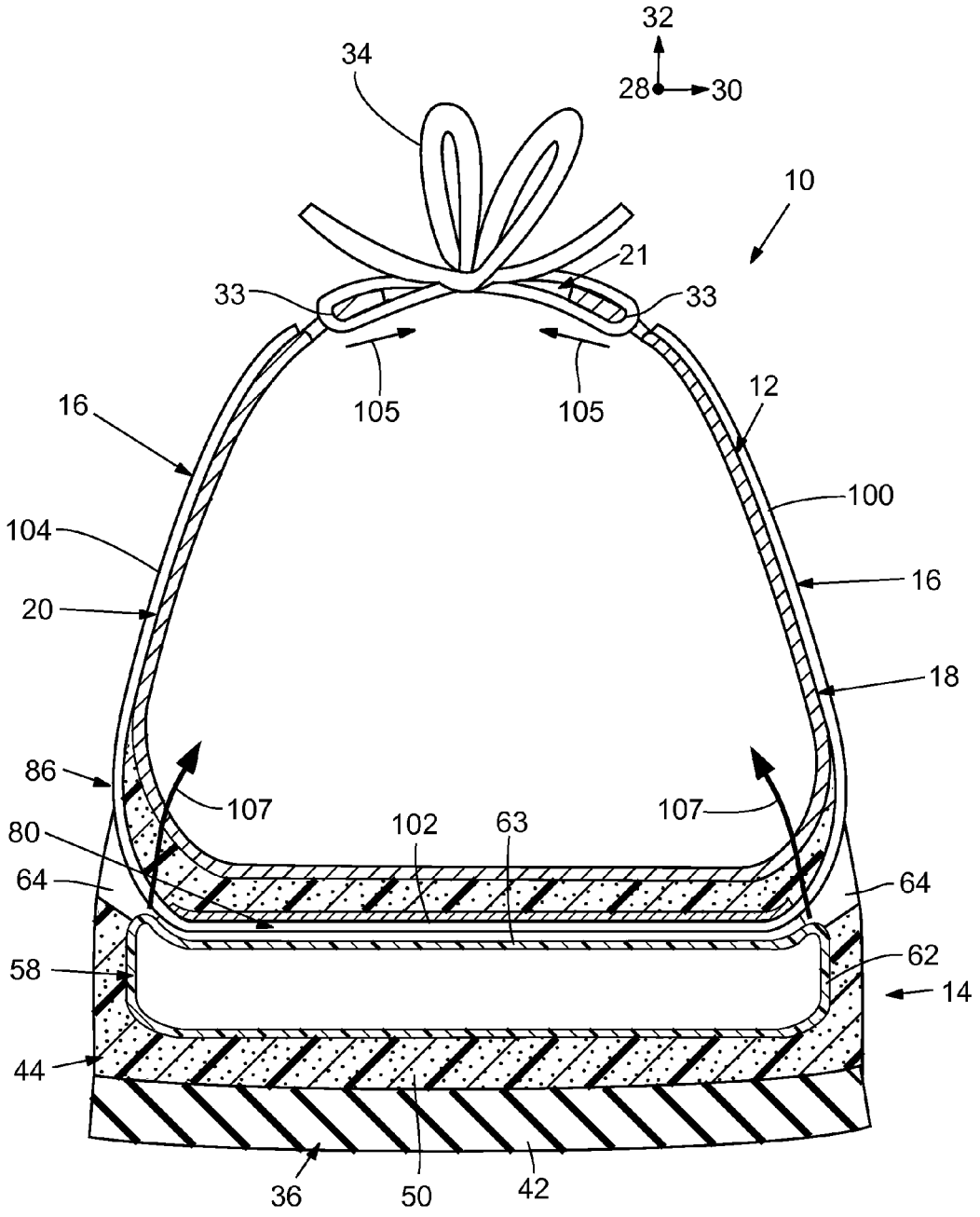
FIG. 4 is a section view of the article of footwear of FIG. 1 showing the tensile strands flexing a bladder of the sole structure according to exemplary embodiments.

The shoelace 34 or other closure element can have an unfastened position, such as the untied position of the shoelace 34 shown in FIG. 3, and a fastened position, such as the tied position of the shoelace 34 shown in FIG. 4. Opposite ends of the shoelace 34 can be pulled taut to increase tension in the shoelace 34 when moving from the unfastened position to the fastened position. It will be appreciated that this can bring the closure areas 23, 31 toward each other and adjust the width sizing of the gap 21. As such, the volume within the upper 12 can be reduced, and the upper 12 can be secured to the wearer's foot. Then, the shoelace 34 can be untied to loosen and release the upper 12 from the wearer's foot.

In the embodiments illustrated, the shoelace 34 is disposed generally at the top of the upper 12 and alternates between eyelets 33 on the medial and lateral sides 18, 20 of the upper 12. However, it will be appreciated that the shoelace 34 could be disposed at another area of the upper 12.

Also, the upper 12 can include a tongue 26 that is moveably disposed within the gap 21 between the medial and lateral sides 18, 20. The tongue 26 is most clearly shown in FIG. 2, and for purposes of clarity, the tongue 26 is shown pivoted out from between the medial and lateral sides 18, 20. The tongue 26 can be pivoted downward so as to extend rearwardly from the forefoot region 22. In this position, the tongue 26 can be disposed within the gap 21, between the shoelace 34 and the wearer's foot to thereby cushion the shoelace 34 on the foot to enhance comfort.

The sole structure 14 will now be discussed in detail. FIGS. 1 and 2 primarily illustrate portions of the sole structure 14 underneath the heel region 24; however, it will be appreciated that these illustrated components can be incorporated into other regions of the sole structure without departing from the scope of the present disclosure.

As shown, the sole structure 14 can include an outsole 36. The outsole 36 can be made from wear-resistant polymeric material, such as rubber, that is textured to impart traction. In the illustrated embodiments, the outsole 36 can include a plurality of pads 38, 40, 42 (FIG. 2) that are independent from each other and that are spaced apart in the longitudinal direction 28. Thus, the lower surfaces of the pads 38, 40, 42 (i.e., the ground engaging surface of the footwear 10) can engage the ground, grass, pavement, or other surface on which the wearer treads. It will be appreciated that the outsole 36 can include any number of pads 38, 40, 42 and the pads 38, 40, 42 can be disposed in any suitable area on the sole structure 14 without departing from the scope of the present disclosure.

The sole structure 14 can also include a midsole 44 that is fixedly secured to a lower surface of upper 12 and an upper surface of the pads 38, 40, 42. In some embodiments, the midsole 44 can be adhesively attached to the upper 12 and/or the pads 38, 40, 42. The midsole 44 can be made from foam, such as polyurethane foam, ethylvinylacetate foam, and the like. Also, the midsole 44 can attenuate ground reaction forces to provide cushioning to the wearer's foot.

As shown in FIG. 2, the midsole 44 can include a plurality of resiliently compressible blocks 46, 48, 50 that are joined by flexible joint portions 51. The blocks 46, 48, 50 and joint portions 51 can be integrally connected so as to be monolithic. The blocks 46, 48, 50 can be hollow and generally block shaped, and the joint portions 51 can be relatively thin and sheet-like. The joint portions 51 can extend between the blocks 46, 48, 50 to connect adjacent blocks 46, 48, 50.

As shown in FIG. 1, the pad 38 can be directly attached to the underside of the block 46, the pad 40 can be directly attached to the underside of the block 48, and the pad 42 can be directly attached to the underside of the block 50. As such, the sole structure 14 can flex about the joint portions 51. The sole assembly 14 can also have sipes 53 (FIG. 1), which are relatively deep channels that are defined between the adjacent blocks 46, 48, 50. Accordingly, the sole structure 14 can have a high degree of flexibility when running, walking, jumping, etc.

Moreover, the midsole 44 can include one or more bladders 58 that can contain a fluid (e.g., a gas, liquid, gel, etc.). As shown in FIG. 2, the bladder 58 can have a plurality of chamber portions 57, 60, 62 that are joined by respective flexible joint portions 55. In some embodiments, the chamber portions 57, 60, 62 can be in fluid communication via passages within the joint portions 55.

The shape of the bladder 58 can be defined in various ways. For instance, to control the shape of the bladder 58, the bladder 58 can contain fabric sheets that are attached to opposing internal surfaces of the bladder 58, and a plurality of tensile yarns can extend between these fabric sheets such that tension in these yarns limits the expansion of the bladder 58. More information can be found, for instance, in U.S. Pat. No. 6,119,371, which issued on Dec. 19, 2000, and which is incorporated by reference in its entirety. The shape of the bladder 58 can also be controlled in other ways, such as welds, seams, etc.

The bladder 58 can be disposed and enclosed within the midsole 44 such that the chamber portion 57 is enclosed within the block 46, the chamber portion 60 is disposed within the block 48, and the chamber portion 62 is disposed within the block 50. Accordingly, the bladder 58 can flex in concert with the midsole 44.

In addition, the sole structure 14 can include a tunnel structure comprising one or more tunnel members 70, 72, 74. The tunnel members 70, 72, 74 can be elongate and can have a U-shaped cross section. Also, the tunnel members 70, 72, 74 can be inverted and attached to an outer surface 63 of the bladder 58. In the embodiments illustrated, the tunnel members 70, 72, 74 are attached to the superior outer surface 63 of the bladder 58. Also, the tunnel members 70, 72, 74 are substantially centered over the chamber portions 57, 60, 62, respectively so as to extend in the transverse direction 30. Furthermore, the tunnel members 70, 72, 74 can be adhesively attached to the outer surface 63.

As such, each tunnel member 70, 72, 74 and the outer surface 63 can cooperate to define tunnels 76, 78, 80 through the sole structure. The tunnels 76, 78, 80 are each indicated in FIG. 1, and a cross section of the tunnel 80 is shown in FIG. 3. Also, the midsole 44 can include a plurality of openings 64, such as holes or slits, that are in communication with the tunnels 76, 78, 80 such that the tunnels 76, 78, 80 can be accessible from outside the footwear 10.

In the embodiments shown, the tunnels 76, 78, 80 are longitudinally straight and extend substantially in the transverse direction 30. However, it will be appreciated that the tunnels 76, 78, 80 can curve and/or can extend in any suitable direction without departing from the scope of the present disclosure. Also, the tunnels 76, 78, 80 can be passageways that are defined by structures other than the tunnel members 70, 72, 74. For instance, the tunnels 76, 78, 80 can be defined by a plurality of separate members that are aligned in the transverse direction 30, or the tunnels 76, 78, 80 can be otherwise defined.

As stated above, the footwear 10 can include a tensile structure 16. In the embodiments illustrated, the tensile structure 16 includes a plurality of strands 82, 84, 86, specifically a first strand 82, a second strand 84, and a third strand 86. However, it will be appreciated that the tensile structure 16 can include any suitable number of strands 82, 84, 86. The tensile structure 16 can also include a thin and flat strap, a composite of these structures, or other structure without departing from the scope of the present disclosure.

The strands 82, 84, 86 can be made from wire, string, cord, various flexible filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and/or steel. An individual filament utilized in the strands 82, 84, 86 may be formed form a single material (i.e., a monocomponent filament) or from multiple materials (i.e., a bicomponent filament). Similarly, different filaments may be formed from different materials. The thickness of strands 82, 84, 86 can be within a range from approximately 0.03 millimeters to 5 millimeters, for example. Also, the strands 82, 84, 86 can have a substantially circular cross section, an ovate cross section, or a cross section of any other suitable shape.

As an example, one or more of the strands 82, 84, 86 may be formed from a bonded nylon 6.6 with a breaking or tensile strength of 3.1 kilograms and a weight of 45 tex. One or more strands 82, 84, 86 may be formed from a bonded nylon 6.6 with a breaking or tensile strength of 6.2 kilograms and a tex of 45. As a further example, one or more strands 82, 84, 86 may have an outer sheath that sheathes and protects an inner core.

In some embodiments, at least one of the strands 82, 84, 86 can have a fixed longitudinal length (e.g., can be nonextendible). In additional embodiments, at least one of the strands 82, 84, 86 can be resiliently extendible. Some of the strands 82, 84, 86 can be nonextendible while others can be extendible in various embodiments as well.

As shown in FIG. 2, the first strand 82 can include a first end 88, a middle portion 90, and a second end 92. The middle portion 90 can be received in the tunnel 76 so as to extend in the transverse direction 30 between the medial and lateral sides 18, 20 of the footwear 10. The first end 88 can turn upward from the middle portion 90 and can be attached to the medial side 18 of the upper 12. The first end 88 can terminate and can be attached to the upper 12 directly adjacent the rear-most eyelet 33 on the closure area 23 of the medial side 18. Similarly, the second end 92 can be attached to the lateral side 20, and the second end 92 can terminate and can be attached to the upper 12 directly adjacent the rear-most eyelet 33 closure area 31 on the lateral side 20. In additional embodiments, the ends 88, 92 wrap at least partially around the periphery of the eyelet 33. Also, the first and second ends 88, 92 can be embedded (e.g., molded) within the materials of the upper 12 in some embodiments, the ends 88, 92 can be adhesively attached to the upper 12, the ends 88, 92 can be attached via fasteners, or the ends 88, 92 can be attached in another suitable fashion. Also, any suitable length of the ends 88, 92 can be attached to the upper 12. For instance, in some embodiments, only a terminal portion of the ends 88, 92 is attached to the upper 12 while other portions of the ends 88, 92 closer to the middle portion 90 are detached from the upper 12. In further embodiments, a greater portion of each end 88, 92 is attached to the upper 12 (e.g., from the terminal portion of the end 88, 92 to the transversely-extending middle portion 90). Meanwhile, the middle portion 90 can be loosely received in the tunnel 76 (i.e., detached from the tunnel member 70 and bladder 58).

The second strand 84 can include a first end 94, a middle portion 96, and a second end 98. The middle portion 96 can extend through the tunnel 78, and the ends 94, 98 can extend upward to attach to the upper 12 directly adjacent the rear-most eyelets 33. Otherwise, the second strand 84 can be attached to the upper 12 and coupled to the sole structure 14 in a manner similar to the first strand 82.

Also, the third strand 86 can include a first end 100, a middle portion 102, and a second end 104. The middle portion 102 can extend through the tunnel 80, and the ends 100, 104 can extend upward to attach directly adjacent the respective rear-most eyelet 33. Otherwise, the third strand 86 can be attached to the upper 12 and coupled to the sole structure 14 in a manner similar to the first and third strands 82, 84.

Thus, the strands 82, 84, 86 can fan away from each other and extend longitudinally away from the same eyelet 33. Stated differently, the strands 82, 84, 86 can converge and extend toward the same eyelet 33. Moreover, the strands 82, 84, 86 can each extend through its own respective tunnel 76, 78, 80.

FIGS. 3-6 illustrate examples of how the strands 82, 84, 86 can function within the footwear 10. FIG. 3 shows the footwear 10 with the shoelace 34 untied and in its unfastened position, and FIG. 3 also shows the bladder 58 in a neutral, unflexed position. When, the shoelace 34 is pulled taut and tied in a knot or otherwise fastened, the medial and lateral sides 18, 20 of the upper 12 can be pulled toward each other as represented by opposing arrows 105 in FIG. 4. This can, in turn, reduce the width of the gap 21. Increasing tension in the shoelace 34 can also increase tension in the strands 82, 84, 86. As a result, the strands 82, 84, 86 can pull the chamber portions 57, 60, 62 of the bladder 58 upward toward the underside of the wearer's foot to a flexed position. For instance, as shown in FIG. 4, the medial and lateral sides of the chamber portion 62 can be partially pulled up and around the medial and lateral sides of the wearer's foot as indicated by opposing arrows 107. The chamber portions 57, 60 can be similarly pulled upward by strands 82, 84, respectively. The strands 82, 84, 86 can also similarly pull the midsole 44 upward toward the wearer's foot.

Figure 5:
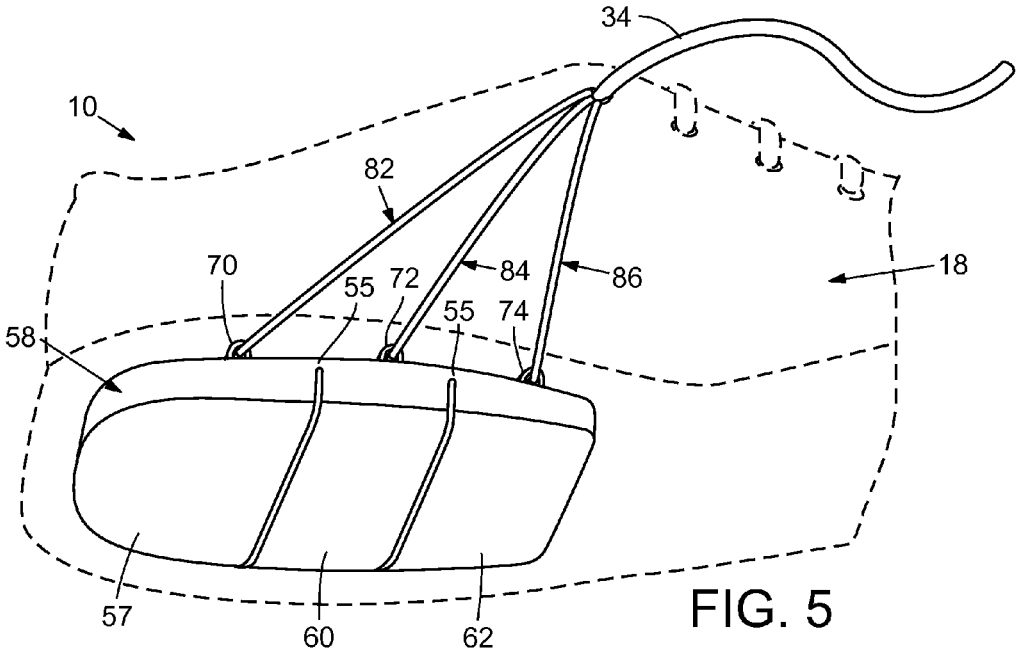
FIG. 5 is a perspective view of portions of the article of footwear of FIG. 1.
Figure 6:
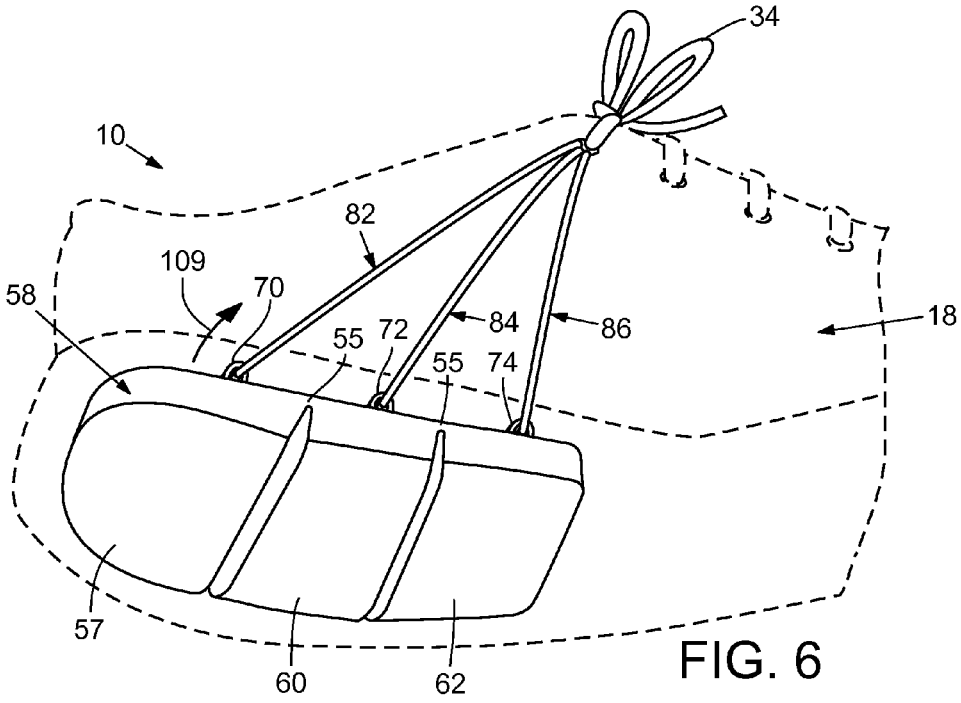
FIG. 6 is a perspective view of the portions of the article of footwear of FIG. 5, wherein the tensile strands are shown flexing the bladder according to additional exemplary embodiments.

Furthermore, FIG. 5 shows the shoelace 34 untied and unfastened, and FIG. 5 also shows the bladder 58 in a neutral, unflexed position. As shown in FIG. 6, as the shoelace 34 is tensioned and tied, the strands 82, 84, 86 can increase in tension to thereby pull and rotate the chamber portion 57 relative to the chamber portion 60 about the respective flexible joint portion 55. Thus, the chamber portion 57 can be flexibly pulled upward toward the wearer's heel as indicated by arrow 109 in FIG. 6.

It will be appreciated that the strands 82, 84, 86 can be tensioned due to tying or otherwise tensioning the shoelace 34 as discussed above. It will also be appreciated that the strands 82, 84, 86 can be tensioned due to the flexure of the upper 12, for instance, due to flexure of the wearer's foot during exercise, etc. Thus, the flexure of the bladder 58 can occur due to movement of the wearer's foot within the footwear 10.

Accordingly, the strands 82, 84, 86 can flex the bladder 58 such that the bladder 58 at least partially "cups" the wearer's foot. Also, the chamber portions 57, 60, 62 and blocks 46, 48, 50 of the midsole 44 can resiliently compress against and partially mold to the wearer's foot for added comfort and support. The tension in the strands 82, 84, 86 can additionally allow the sole structure 14 to flex closely with the movements of the wearer's foot. As such, the footwear 10 can conform to the foot and, yet, the footwear 10 can be comfortable to wear. Moreover, the bladder 58 can change in volume so as to increase in pressure for added support. Accordingly, the footwear 10 can enhance the wearer's running, jumping, cutting, and other movements.

Figure 7:
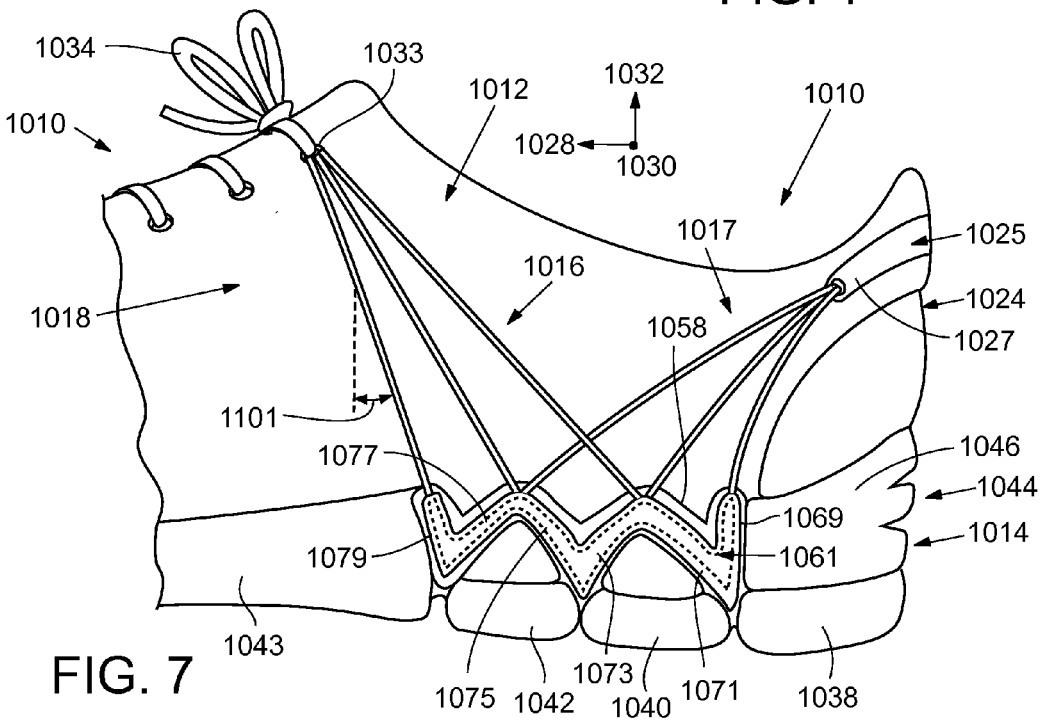
FIG. 7 is a side view of an article of footwear according to additional embodiments of the present disclosure.
Figure 8:
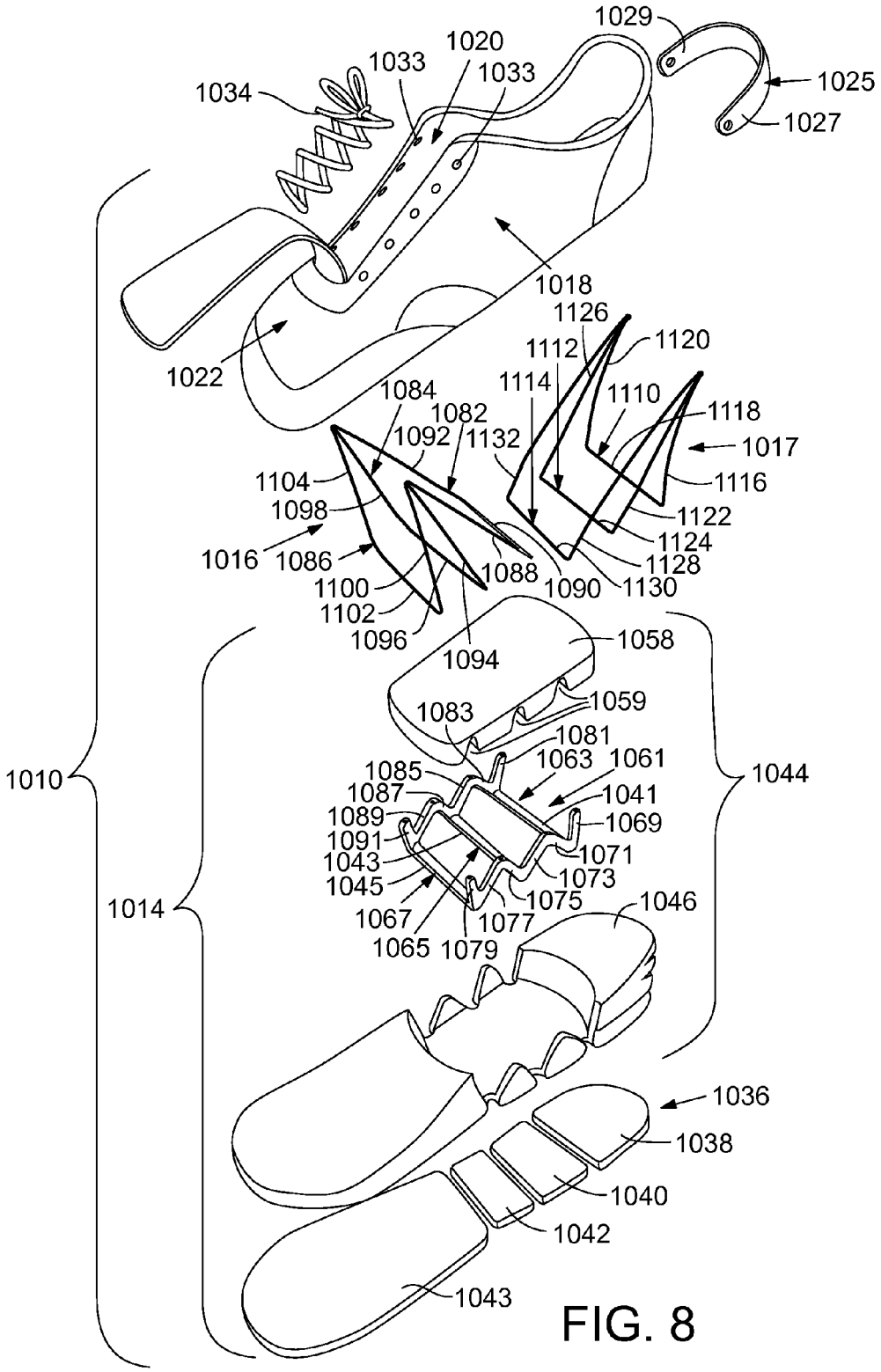
FIG. 8 is an exploded view of the article of footwear of FIG. 7.

Referring now to FIGS. 7 and 8, additional embodiments of the article of footwear 1010 will be discussed. The footwear 1010 can incorporate at least some of the features discussed in regard to the embodiments of FIGS. 1-6. Generally, the footwear 1010 can include an upper 1012, a sole structure 1014, and one or more tensile structures 1016, 1017, each of which will be discussed in more detail below.

The upper 1012 can be similar to embodiments discussed above. The upper 1012 can also include a heel strap 1025 that extends across the heel region 1024 of the upper 1012. More specifically, the heel strap 1025 can extend across the heel region 1024, can terminate on the medial side 1018 at a first end 1027, and can terminate on the lateral side 1020 at a second end 1029. The heel strap 1025 can be attached to underlying portions of the upper 1012 via stitching, adhesives, or otherwise. The upper 1012 can also include eyelets 1033 that receive one or more shoelaces 1034. It will be appreciated that the footwear 1010 can include other closure elements, such as clamps, buckles, hook-and-loop tape, etc.

The sole structure 1014 can include an outsole 1036 with a plurality of pads 1038, 1040, 1042, 1043, similar to the embodiments discussed above. Also, the sole structure 1014 can include a midsole 1044 with a block 1046 of resiliently compressible material, such as foam. As shown in FIG. 8, the block 1046 can be recessed on its superior surface so as to receive a bladder 1058 that contains a fluid, such as gas, liquid, gel, etc. Like the embodiments discussed in relation to FIGS. 1-6, the bladder 1058 can be an articulated bladder and can include a plurality of chamber portions that are joined by flexible joint portions. Thus, the bladder 1058 can have one or more channels 1059, grooves, slits, contours, etc. The channels 1059 can face toward the outsole 1036 in the embodiments shown in FIG. 8.

The sole structure 1014 can further include a cage 1061, which is most clearly shown in FIG. 8. The cage 1061 can be made from a somewhat flexible polymeric material, such as polyether block amide (PBAX™). The cage 1061 can also be hollow or can otherwise define one or more passages 1063, 1065, 1067 therethrough. The passages 1063, 1065, 1067 of the cage 1061 can be interconnected and can fluidly communicate with each other. The cage 1061 can extend about the bladder 1058 such that portions of the cage 1061 are received within corresponding ones of the channels 1059. Accordingly, the cage 1061 can be coupled to the bladder 1058. In some embodiments, the cage 1061 can incorporate the teachings of U.S. Pat. No. 6,665,958, which issued Dec. 23, 2003, and which is incorporated by reference in its entirety. The cage 1061 can support, reinforce, and protect the bladder 1058 as will be discussed.

Also, the cage 1061 can define middle portions 1041, 1043, 1045, which can each define respective portions of the passages 1063, 1065, 1067. The middle portions 1041, 1043, 1045 can extend longitudinally in the transverse direction 1030 underneath the wearer's foot, and the portions 1041, 1403, 1045 can be substantially parallel and spaced apart in the longitudinal direction 1028. The middle portions 1041, 1043, 1045 can also be received within the channels 1059 of the bladder 1058.

The cage 1061 can also include a plurality of upturned medial ends 1069, 1071, 1073, 1075, 1077, 1079, which can each define respective portions of the passages 1063, 1065, 1067. The ends 1069, 1071 can communicate with and branch from the middle portion 1041, the ends 1073, 1075 can communicate with and branch from the middle portion 1043, and the ends 1077, 1079 can communicate with and branch from the middle portion 1045. Also, the ends 1069, 1071, 1073, 1075, 1077, 1079 can extend superiorly from the respective middle portions 1041, 1043, 1045. Moreover, as shown in FIG. 7, the ends 1069, 1071, 1073, 1075, 1077, 1079 can extend at a positive angle relative to the superior-inferior direction 1032 (i.e., nonparallel with the direction 1032). The angle of the end 1079 is indicated at 1101 in FIG. 7 as an example. Additionally, the ends 1071, 1073 can angle toward each other in the superior direction and can be connected. Likewise, the ends 1075, 1077 can angle toward each other in the superior direction and can be connected.

As shown in FIG. 8, the cage 1061 can further include a plurality of upturned lateral ends 1081, 1083, 1085, 1087, 1089, 1091, which can each define respective portions of the passages 1063, 1065, 1067. The ends 1081, 1083, 1085, 1087, 1089, 1091 can be connected to and can communicate with the middle portions 1041, 1043, 1045 of the tubes 1063, 1065, 1067. The ends 1081, 1083, 1085, 1087, 1089, 1091 can be configured to mirror the ends 1069, 1071, 1073, 1075, 1077, 1079, albeit on the lateral side 1020 of the footwear 1010.

As shown in FIG. 7, the ends 1069, 1071, 1073, 1075, 1077, 1079 can be exposed on the exterior of the medial side 1018 of the sole structure 1014. Similarly, the ends 1081, 1083, 1085, 1087, 1089, 1091 can be exposed on the lateral side 1020 of the sole structure 1014.

The tensile structure 1016 (i.e., closure tensile structure) can include a first strand 1082, a second strand 1084, and a third strand 1086. The strands 1082, 1084, 1086 can be somewhat similar to the strands 82, 84, 86 of the embodiments of FIGS. 1-6. However, the end 1088 of strand 1082 can be attached to the upper 1012 adjacent the rear-most eyelet 1033 on the medial side 1018 and can extend downward to be received within the upturned end 1071 of the cage 1061 (FIG. 7). Also, the middle portion 1090 of the strand 1082 can extend through the middle portion 1041 of the cage 1061. Furthermore, the end 1092 can extend out from the cage 1061 via the end 1083 and can be operably coupled to the rear-most eyelet 1033 on the lateral side 1020.

The end 1094 of the second strand 1084 can be attached to the upper 1012 adjacent the rear-most eyelet 1033 on the medial side 1018 and can extend downward to be received within the upturned end 1075 of the cage 1061 (FIG. 7). Also, the middle portion 1096 of the strand 1082 can extend through the middle portion 1043 of the cage 1061. Furthermore, the end 1098 of the strand 1084 can extend out from the cage 1061 via the end 1087 and can be operably coupled to the rear-most eyelet 1033 on the lateral side 1020.

Additionally, the end 1100 of the third strand 1086 can be attached to the upper 1012 adjacent the rear-most eyelet 1033 on the medial side 1018 and can extend downward to be received within the upturned end 1079 of the cage 1061 (FIG. 7). Also, the middle portion 1102 of the strand 1082 can extend through the middle portion 1045 of the cage 1061. Furthermore, the end 1104 of the strand 1086 can extend out from the cage 1061 via the end 1091 and can be operably coupled to the rear-most eyelet 1033 on the lateral side 1020.

Thus, the strands 1082, 1084, 1086 can operably couple the upper 1012 (and particularly, the closure regions 1023, 1031 of the upper 1012) to the sole structure 1014, similar to the embodiments discussed above. Also, tension in the strands 1082, 1084, 1086 can cause flexure of the bladder 1058 and other portions of the sole structure 1014 as discussed above with respect to FIGS. 4 and 6. Moreover, the cage 1061 can help to reinforce and protect the bladder 1058 by distributing forces from the strands 1082, 1084, 1086 onto the bladder 1058.

As mentioned above, the footwear 1010 can also include tensile structure 1017 (i.e., heel tensile structure). In the embodiments illustrated, the structure 1017 can include one or more strands 1110, 1112, 1114, which operably couple the heel strap 1025 to the sole structure 1014. Like the strands 1082, 1084, 1086, the strands 1110, 1112, 114 fan apart extending away from the heel strap 1025 and converge extending toward the heel strap 1025.

Specifically, an end 1116 of the strand 1110 can be attached to the end 1027 of the heel strap 1025 via adhesives, via fasteners, by being tied to the end 1027 of the heel strap 1025, or in another way. The end 1116 can also extend across the medial side 1018 of the upper 1012 to be received within the upturned end 1069 of the cage 1061. Moreover, a middle portion 1118 of the strand 1110 can extend through the portion 1041 of the cage 1061, and an end 1120 of the strand 1110 can exit the cage 1061 via the upturned end 1081. The end 1120 of the strand 110 can extend across the upper 1012 to be attached to the end 1029 of the heel strap 1025. Again, the end 1120 can be attached to the heel strap 1025 via adhesives, via fasteners, by being tied to the end 1029, or in another way.

The strands 1112, 1114 can be similarly incorporated within the footwear 1010. However, an end 1122 of the strand 1112 can extend from the end 1027 of the heel strap 1025 and into the cage 1061 via the upturned end 1073. Also, a middle portion 1124 of the strand 1112 can extend through the middle portion 1043, and an end 1126 of the strand 1112 can exit the cage 1061 via the upturned end 1085 to attach to the end 1029 of the heel strap 1025. Moreover, an end 1128 of the strand 1114 can extend from the end 1027 of the heel strap 1025 and into the cage 1061 via the upturned end 1077. Also, a middle portion 1130 of the strand 1114 can extend through the middle portion 1045, and an end 1132 of the strand 1114 can exit the cage 1061 via the upturned end 1089 to attach to the end 1029 of the heel strap 1025.

As such, increasing tension within the strands 1110, 1112, 1114 can flex the bladder 1058 as discussed above with respect to strands 1082, 1084, 1086 and can also pull the heel strap 1025 toward the wearer's heel. The bladder 1058 can also change in volume and increase in pressure due to tensioning the strands 1082, 1084, 1086 to provide better support for the wearer's foot. Additionally, repeated plantarflexion and dorsiflexion of the foot (e.g., during walking and running) can cause cyclical and alternating flexure of the bladder 1058 and pulling of the heel strap 1025 toward the wearer's heel. As such, the fit of the footwear 1010 can adjust during flexure of the wearer's foot for a so-called "active fit" of the footwear 1010.

In summary, the footwear 10, 1010 discussed herein can provide comfort and support for the wearer. Also, the fit of the footwear 10, 1010 can adjust when tying the shoelaces 34, 1034 and/or during flexure of the wearer's foot for added comfort, stability, and support. As such, the wearer can exercise, run, jump, cut, pivot, and otherwise move with enhanced ability and performance.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. An article of footwear configured for wearing on a foot of a wearer, the article of footwear comprising:

an upper having a first area and a second area;

a sole structure that is coupled to the upper, the sole structure including a bladder that contains a fluid; and a tensile structure that is coupled to the first area of the upper, extends through the sole structure, and that is coupled to the second area of the upper, the tensile structure operably coupled to the bladder, the tensile structure operable to flex the bladder due to an increase in tension in the tensile structure.

2. The article of footwear of claim 1, wherein the bladder includes an outer surface, and further comprising a tunnel member that is coupled to the outer surface, the tunnel member and the outer surface cooperating to define a tunnel through the sole structure, the tensile structure extending through the tunnel to operably couple to the bladder.

3. The article of footwear of claim 1, wherein the bladder includes a first chamber portion and a second chamber portion, the first chamber portion and the second chamber portion being attached by a flexible joint portion, a channel being defined between the first chamber portion, the second chamber portion and the flexible joint portion, the tensile structure extending through the channel to operably couple to the bladder.

4. The article of footwear of claim 3, further comprising a cage that supports the bladder and that is coupled to the bladder, the cage defining a passage, the tensile structure extending through the passage to operably couple to the bladder.

5. The article of footwear of claim 4, wherein the passage has a middle portion that generally extends through the sole structure, and wherein the passage includes at least one upturned end that extends from the middle portion generally toward the upper.

6. The article of footwear of claim 5, wherein the upper includes a medial side and a lateral side, wherein the passage includes a medial upturned end that extends from the middle portion generally toward the medial side of the upper, and wherein the passage includes a lateral upturned end that extends from the middle portion toward the lateral side of the upper.

7. The article of footwear of claim 5, wherein the upper defines a superior-inferior direction, and wherein the at least one upturned end is disposed at a positive angle relative to the superior-inferior direction.

8. The article of footwear of claim 1, wherein the first area is defined on a medial side of the upper and the second area is defined on a lateral side of the upper.

9. The article of footwear of claim 1, wherein at least one of the first area and the second area includes a closure area, the closure area operable to provide support for a closure element, the tensile structure being coupled to the closure area and operable to increase in tension when the closure element moves from an unfastened position to a fastened position.

10. The article of footwear of claim 9, wherein the closure area includes an opening that is operable to reduce in size when the closure element moves from the unfastened position to the fastened position, and further comprising the closure element.

11. The article of footwear of claim 10, wherein the closure element is a shoelace.

12. The article of footwear of claim 1, wherein the first area includes a first end of a heel strap and the second area includes a second end of a heel strap, the heel strap extending over a heel region of the upper, and wherein the tensile structure is coupled to the first end of the heel strap, extends through the sole structure, and is coupled to the second end of the heel strap.

13. The article of footwear of claim 1, wherein the tensile structure has a substantially fixed longitudinal length.

14. The article of footwear of claim 1, wherein the tensile structure includes at least one strand.

15. An article of footwear configured for wearing on a foot of a wearer, the article of footwear comprising:

an upper having a first closure area and a second closure area that are separated by a gap, the first closure area and the second closure area operable to support a closure element that has an unfastened position and a fastened position, the closure element operable to reduce a size of the gap to selectively secure the upper to the foot of the wearer when moving from the unfastened position to the fastened position;

a sole structure that is coupled to the upper, the sole structure including a bladder that contains a fluid; and a closure tensile structure that is coupled to the first closure area of the upper, extends through the sole structure, and that is coupled to the second closure area of the upper, the closure tensile structure operably coupled to the bladder, the closure tensile structure operable to flex the bladder when the closure element moves from the unfastened position to the fastened position.

16. The article of footwear of claim 15, wherein the bladder includes an outer surface, and further comprising a tunnel member that is coupled to the outer surface, the tunnel member and the outer surface cooperating to define a tunnel through the sole structure, the closure tensile structure extending through the tunnel to operably couple to the bladder.

17. The article of footwear of claim 15, wherein the bladder includes a first chamber portion and a second chamber portion, the first chamber portion and the second chamber portion being attached by a flexible joint portion, a channel being defined between the first chamber portion, the second chamber portion and the flexible joint portion, the closure tensile structure extending through the channel to operably couple to the bladder.

18. The article of footwear of claim 17, further comprising a cage that supports the bladder and that is at least partially received in the channel to couple to the bladder, the cage defining a passage, the closure tensile structure extending through the passage.

19. The article of footwear of claim 15, wherein at least one of the first closure area and the second closure area includes an opening that is configured to receive the closure element, the closure tensile structure being coupled to the at least one of the of the first closure area and the second closure area adjacent the opening.

20. The article of footwear of claim 15, further comprising the closure element, and wherein the closure element is a shoelace.

21. The article of footwear of claim 15, wherein the closure tensile structure includes at least one strand.

22. The article of footwear of claim 15, wherein the upper further includes a heel strap that extends over a heel region of the upper, and further comprising a heel tensile structure that is coupled to a first end of the heel strap, extends through the sole structure, and that is coupled to the second end of the heel strap, the heel tensile structure operably coupled to the bladder and operable to flex the bladder.

23. An article of footwear configured for wearing on a foot of a wearer, the article of footwear comprising:

an upper having a medial side with a first eyelet and a lateral side with a second eyelet, a gap defined between the medial side and the lateral side;

a shoelace received in the first eyelet and the second eyelet and operable to selectively move at least one of the first eyelet and the second eyelet toward the other to selectively secure the upper to the foot of the wearer;

a heel strap that extends across a heel region of the upper, the heel strap including a first end disposed on the medial side and a second end disposed on the lateral side;

a sole structure that is coupled to the upper, the sole structure including a bladder that contains a fluid, the bladder including a first chamber portion, a second chamber portion, and a flexible joint portion that couples the first chamber portion and the second chamber portion;

a plurality of closure strands that are coupled to upper adjacent the first eyelet, that fan apart from the first eyelet, that extend through sole structure, that converge toward the second eyelet, and that are coupled to the upper adjacent the second eyelet, the plurality of closure strands being operably coupled to the bladder and being collectively operable to flex at least one of the first chamber portion and the second chamber portion relative to the other as a result of the shoelace securing the upper to the foot of the wearer; and a plurality of heel strands that are coupled to the first end of the heel strap, that fan apart from the first end of the heel strap, that extend through the sole structure, that converge toward the second end of the heel strap, and that are coupled to the second end of the heel strap, the plurality of heel strands being operably coupled to the bladder and being collectively operable to flex at least one of the first chamber portion and the second chamber portion relative to the other as a result of flexure of the upper.

* * * * *